US005553903A

United States Patent [19]

Prete et al.

[11] Patent Number: 5,553,903

[45] Date of Patent: Sep. 10, 1996

[54] WINDOW VENT STOP

[75] Inventors: James G. Prete, Hinsdale, Ill.; Steven E. Schultz, Demontte, Ind.; Allen D. Polowinczak, Plainfield, Ill.

[73] Assignee: Ashland Products, Inc., Lowell, Ind.

[21] Appl. No.: 293,483

[22] Filed: Aug. 22, 1994

[51] Int. Cl.[6] ..... E05C 1/08

[52] U.S. Cl. ..... 292/163; 292/138

[58] Field of Search ..... 292/138, 333, 292/DIG. 15, DIG. 46, 163

[56] References Cited

U.S. PATENT DOCUMENTS

| | | | |
|---|---|---|---|
| 163,008 | 5/1875 | Gillespie et al. . | |
| 666,596 | 1/1901 | Breen . | |
| 976,777 | 11/1910 | Brown . | |
| 1,261,274 | 4/1918 | Newsam . | |
| 1,388,272 | 8/1921 | Lawrence . | |
| 1,895,146 | 1/1933 | Brown | 292/DIG. 15 X |
| 2,249,132 | 7/1941 | Haslam | 20/52 |
| 2,850,312 | 9/1958 | Rifkin | 292/149 |
| 2,950,136 | 8/1960 | Pengelly | 292/64 |
| 3,021,163 | 2/1962 | Hoffmann | 292/147 |
| 4,303,266 | 12/1981 | Volpi | 292/DIG. 15 X |
| 4,400,026 | 8/1983 | Brown, Jr. | 292/DIG. 47 X |
| 4,553,353 | 11/1985 | Simpson | 49/161 |
| 4,578,903 | 4/1986 | Simpson | 49/175 |
| 4,797,970 | 1/1989 | Charlton | 292/DIG. 15 X |
| 4,923,230 | 5/1990 | Simpson | 292/67 |
| 4,932,694 | 6/1990 | Cater, Sr. | 292/DIG. 20 X |
| 5,018,241 | 5/1991 | Baines | 292/DIG. 15 X |
| 5,096,240 | 3/1992 | Schultz | 292/153 |
| 5,165,737 | 11/1992 | Riegelman | 292/DIG. 47 X |
| 5,248,174 | 9/1993 | Matz et al. | 292/228 |

FOREIGN PATENT DOCUMENTS

| | | |
|---|---|---|
| 1316965 | 4/1993 | Canada . |

*Primary Examiner*—Steven N. Meyers
*Assistant Examiner*—Monica E. Millner
*Attorney, Agent, or Firm*—Wallenstein & Wagner, Ltd.

[57] ABSTRACT

An economical, efficient window stop includes a narrow, flat housing having first and second cavities for respective flat, narrow bolt and latch. The bolt is spring braced and movable between a first portion within the cavity and a second position extending from the cavity. The latch is spring biased and moves transverse to the movement of the bolt. High strength molded plastic construction with guide means and close tolerances allow efficient distribution of forces from the extended bolt to the housing.

20 Claims, 2 Drawing Sheets

10
12
14
16
18
2
d
30
33
33a
21
55
4
60
60a
60b
60e
60f
60g
BP1
BP2
64a
64b
66
66a
67a
67b
80
35
27
27a
3
96
69
63
29
93a
24a
24
LP1
20
93
51
24a
68
90
90d
52
82
54a
97
98
45c
54
LP2
45b
45a
45
91
46
92
43

WINDOW VENT STOP

BACKGROUND

This invention relates generally to a stop means for selectively limiting the movement of sliding members and more particularly concerns a small, efficient means for permitting the alternative of limiting the amount of movement of windows, both those which slide vertically as well as horizontally.

Being able to selectively limit the distance a sliding window member may travel is important, for example to allow windows to be opened for their venting function but yet in certain circumstances permit limiting the opening to inhibit egress in or out through the window.

While means for effecting such selective movement limitation of sliding sash windows assemblies are known as shown for example in U.S. Pat. Nos. 4,824,154; 4,923,230 and 5,248,174, wherein a tumbler may be selectively raised from a recessed position in which the window may be fully opened to an operative position in which the tumbler limits movement of a window member in a sash window assembly, there remains a need for an even smaller, simpler and more rugged stop member.

Also, in certain window combinations wherein a window member slides along a track between its closed and open position, Applicants have found that it is desirable to position the security stop member directly in the track structure. This position dictates certain size requirements, e.g., relatively narrow and long to fit within a track. With the stop means in the track raised to its operative stopping position, the stop means may be subject to high impact if the window slides into it with force. Being able to successfully and consistently resist such inadvertent or deliberate high force impacts over the long expected useful life of the window and yet continue to be easily operated and function properly and smoothly is critical to the function of the stop means.

SUMMARY OF THE INVENTION

Accordingly, it is an object of the invention to overcome the limitations of the known prior art and to provide a means for selectively limiting the sliding movement of windows.

These and other objects are met by the present invention wherein there is disclosed a stop means comprising a narrow bolt and latch arranged in respective first and second cavities in a narrow housing. To achieve all of these objectives without compromise, Applicants have provided a construction in which a minimal number of elements closely interfit with each other over a relatively large interfacing area and cooperate so that the sustained impact energy is spread over this relatively larger area and transferred to the housing.

The stop means for limiting movement of a sliding window means according to the invention comprises a housing having a first and second cavity adjacent to each other for receiving respective bolt and latch therein. The bolt operatively associated with said first cavity is movable along a predetermined first path between a first position wherein the bolt is locked within the first cavity against an outward bias, and a second position wherein the bolt has a first portion extending out of the first cavity and a second portion within the first cavity. In the second position the first portion is adapted to contact the sliding window means as it reaches the limit of its movement and the second portion is adapted to transfer any forces resulting from the contact to the housing.

A latch lies within the second cavity and is movable along a second path in a direction transverse to the first path between a first position and a second position. In the first position, the latch is biased toward and engages the bolt. In the second position, the latch is out of contact with the bolt to allow the bolt to reach its second position.

An actuator on the latch facilitates movement of the latch between its first position and its second position to unlock the bolt.

A first spring positioned between the housing and the bolt biases the bolt toward the first position. The bolt has a guide associated therewith for maintaining the bolt within close tolerance of the first path, and for absorbing and helping distribute to the housing the forces adapted to be received from the contact of the sliding window means with the bolt.

The guide is located at the interfaces between the bolt and the housing. It guides the bolt along the first path and transfers lateral loads from the bolt to the housing. More specifically the first cavity and the bolt each includes first and second surfaces with the first surface of the cavity facing and closely spaced to the first surface of the bolt and the second surface of the cavity facing and closely spaced to the second surface of the bolt. One of each of the pairs of first and second surfaces has either a rail-like guide projection or a corresponding recess receiving the rail-like guide projection in a close tolerance relationship. This combination not only helps to guide the bolt along the first path but also absorbs and transfers forces between the bolt and the housing.

The housing also may have a slot therethrough in a first wall of the first cavity, cooperating with a hook protrusion on the bolt for guiding and stopping movement of the bolt between and at the first and second portions. The slot are oriented in the direction of the first path of travel of the bolt. The hook means are on the second position of the bolt and project into the slot so that the hook means are slidable in the slot along the first path between the first and second positions of the bolt for guiding and stopping the movement of the bolt.

Other features and advantages of the invention will be apparent from the following specification taken in conjunction with the following drawings.

DETAILED DESCRIPTION

Figures 1, 2:
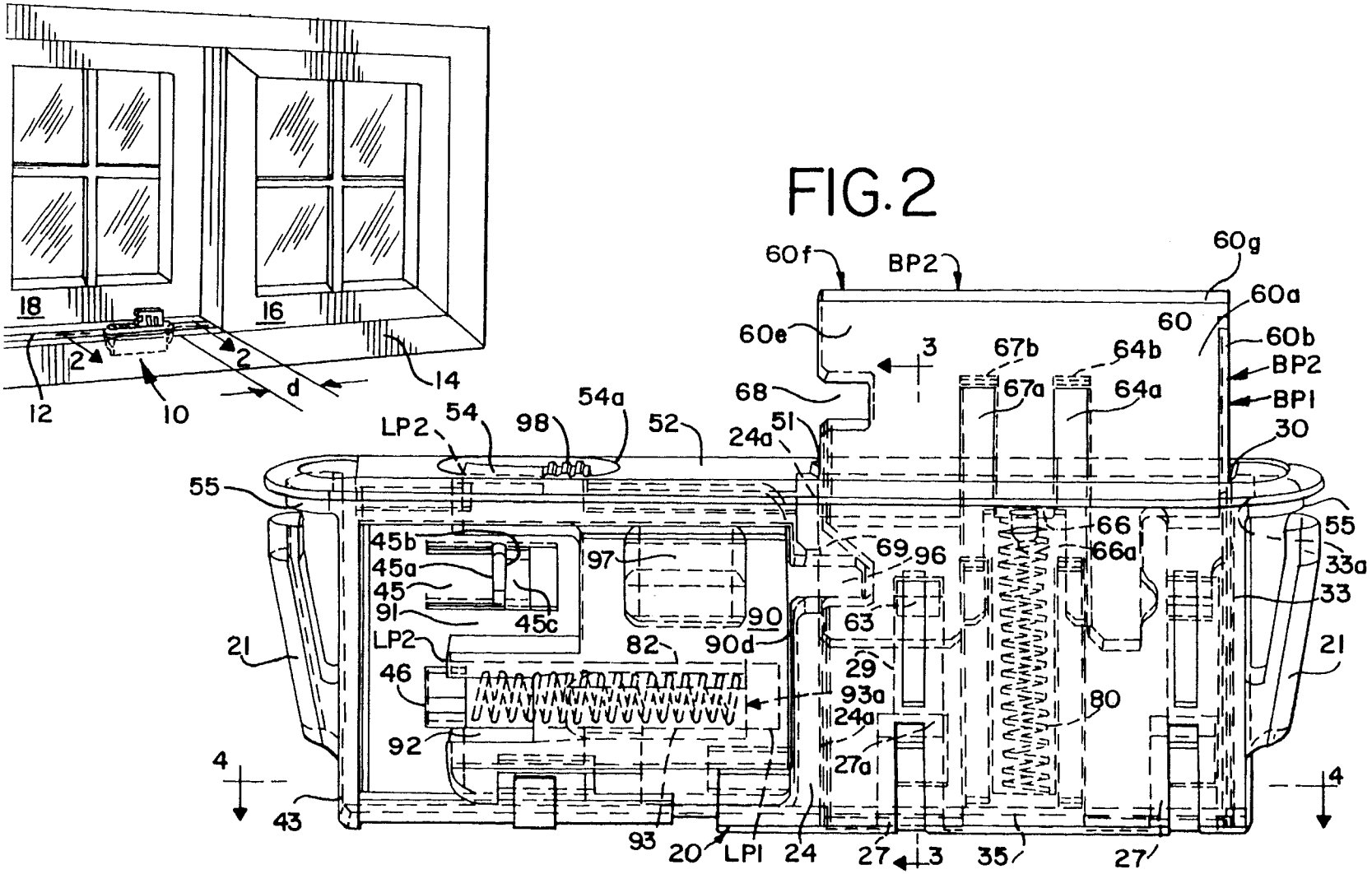
FIG. 1 is a perspective view of an embodiment of the invention in use on a sliding window.
FIG. 2 is a perspective view of an embodiment of the invention shown in FIG. 1 with the stopper bolt in its operative position.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring to the drawings, FIG. 1 shows a perspective, partially exploded view of an embodiment of the window stop lock invention generally indicated at 10 being used in a narrow recess portion of a track 12 of a sliding window frame 14. It may also be used in other environments such as conventionally placed in a stile of a sash window, not shown. In the sliding window environment, the window stop lock 10 functions in its operative or second position to limit movement of sliding window portion 16 to a distance "d" but yet when in its inoperative or first position the stop lock 10 allows portion 16 to be fully opened. The window stop lock 10 according to the disclosed embodiment of the invention as shown in FIG. 2 comprises a housing generally indicated at 20 having a bolt generally indicated at 60 received in a first cavity 30 in the housing 20. The bolt 60 is movable between a first position BP1 wherein it is within the cavity 30 below an outer surface 52 of a cover plate 50 and a second, operative position BP2 as shown in FIG. 2 wherein it has a substantial first portion 60a projecting out of the cavity. In the second position BP2, the stop lock 10 will restrict movement of sliding window 16 to the distance "d" shown in FIG. 1.

A first spring generally indicated at 80 is compressed between a backwall portion 35 of the housing 20 and an inner portion 66 of the bolt 60 and serves to urge the bolt 60 toward the second bolt position BP2. A protrusion 66*a* on bolt 60 helps secure the spring 80 in position.

A latch generally indicated at 90 for selectively positioning the bolt is situated in a second cavity 40 of housing 20. The latch 90 is movable between a first position LP1 and a second position LP2. In the first position LP1 a protruding portion 96 on a first end 90*d* of the latch engages either a first notch 68 on the bolt to retain the bolt in its first position BP1 60 or it engages a second notch 69 in bolt 60 to retain the bolt in its second position BP2. The protrusion 96 and the notches 68, 69 are of an appropriate geometry shown to provide secure and smooth retention and operations. In the second position LP2, the protruding portion 96 is not in contact with the bolt 60 and clear of the notches 68 and 69 to allow the spring 80 to move the bolt 60 to its second position BP2. The direction of movement of the latch 90 is transverse to the direction of movement of the bolt 60. A recess 97 is provided for material reduction and productivity purposes. When the bolt 60 is impacted in its extended position, the bolt 60 rotates, and the notch 69 begins to lift, which in turn lifts the latch 90 by means of the protruding portion 96. This action drives the top surface of the protruding portion 96 into the bottom surface of the slot through which the protruding portion 96 extends. Tests have shown a significant increase in resistance to impact as a result of this action.

A second spring generally indicated at 82 is compressed between a first end anchor 46 on housing 20 and an end wall 93*a* of a spring receiving groove 93 in the latch member 90 to bias the latch 90 and protrusion 96 toward and into contact alternatively with the bolt member 60, the first notch 68 or the second notch 69. The second notch 69 has an inclined cam surface in a position and of a configuration which serves to move protrusion 96 toward its second position when the bolt 60 is moved from its second to its first position. The protrusion and notch configurations together with the spring bias of latch 90 serves to ensure that protrusion 96 will snap into place in the notches 68, 69.

A latch actuator member 98 extending from and integrally connected with the latch 90 protrudes through an opening 54 in face plate 50 and allows movement of the latch 90 by an operator's fingers or other pressure against the bias of spring 82, whereby the latch 90 may be disengaged from the bolt 60. The actuator may have a roughed or knurled surface to facilitate gripping, as with a finger tip.

Means for limiting window movement must be able to absorb the high potential shock of inadvertent or deliberate impacts which could occur during service. They also must be economical, easily maintained and aesthetically pleasing. To achieve all of these objectives without compromise, Applicants have provided a construction in which a minimum number of elements closely interfit with each other over a relatively large interfacing area and cooperate so that the sustained impact energy is transferred to and spread over this relatively larger area.

Thus, lock 10 advantageously is narrow to allow it to fit in the narrow tracks 12 typically used in sliding windows 16. To allow maximum strength with minimum size, weight and cost, the narrow construction of the housing 20 has openings or thin portions in the range of 0,038" to 0,050", wherever possible. In the embodiment as shown, the housing 20, not including the face plate 50, is of a generally rectangular outer configuration approximately 2" long, 3/16" wide and 7/8" deep. The face plate 50 in this embodiment is 3/8" wide and 2 7/16" long, leaving the housing 20 with an effective width of 3/16". The opening into which it is fitted will be between slightly greater than the housing outer dimension. Corresponding dimensions of the rectangularly shaped bolt are approximately 15/16" by 1/8" by 7/8" and the rectangularly shaped latch are 7/8" by 1/8" by 7/8".

Figure 3:
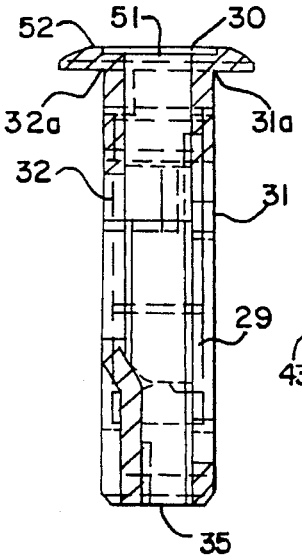
FIG. 3 is a cross sectional view of the embodiment of FIG. 2 taken along line 3—3.
Figure 4:
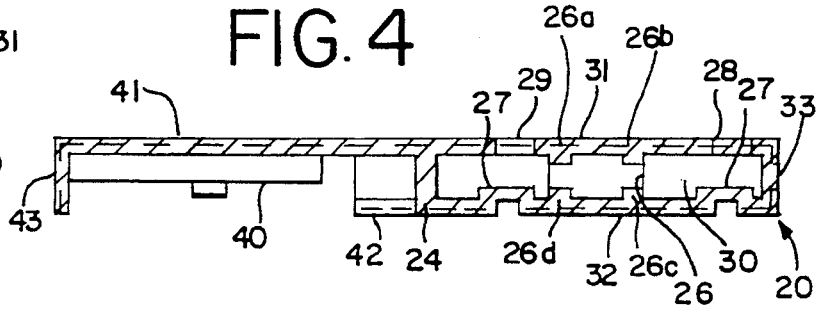
FIG. 4 is a cross sectional view of the embodiment of FIG. 2 taken along line 4—4.

The first cavity 30 is defined by a pair of first and second spaced, generally parallel and planar side walls 31 and 32, respectively, connected together as best seen in FIG. 4 at their side edges by a pair of opposed, generally parallel and planar third and fourth side walls 33 and 24 respectively. As shown in FIG. 3, sidewalls 31, 32, 33 and 24 have respective upper edges 31*a*, 32*a*, 33*a* and 24*a* integrally formed with the face plate 50 and form a rectangularly shaped opening 51 through which the bolt 60 moves. The lower edges of these same sidewalls are interconnected opposite of the opening 51 to a back or inside wall 35. The bolt 60 passes through the opening 51 and the spring 80 bears against the back wall 35.

Figure 5A:
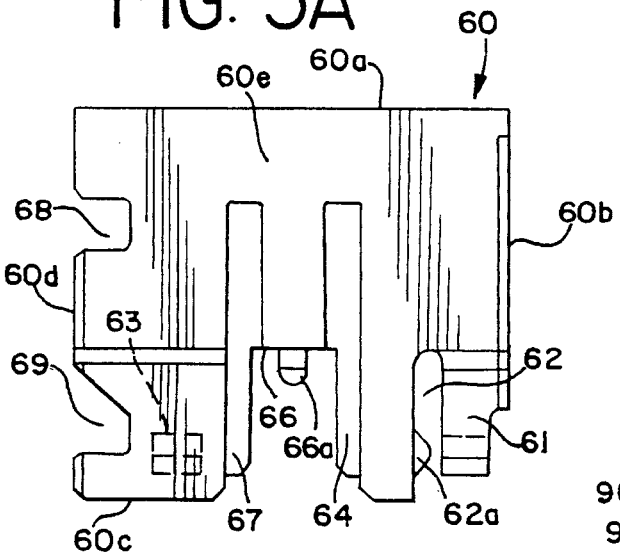
FIG. 5A is a plan view of the stopper bolt of FIG. 2.
Figure 5B:
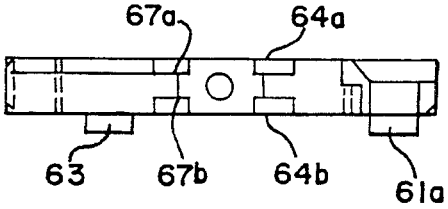
FIG. 5B is an end view of the stopper of FIG. 5A.
Figure 6:
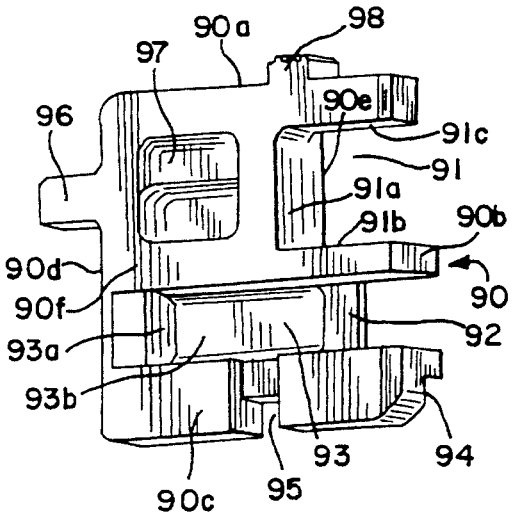
FIG. 6 is a perspective view of a latch of FIG. 2 as seen from the reverse side.

As may be seen in FIG. 4, each of the first and second walls 31, 32 includes runner guides 26 that take the form of pairs of parallel, spaced raised rail-like portions, 26*a*, 26*b* and 26*c*, 26*d* on walls 31 and 32 respectively that interfit closely with cooperating indentations on bolt 60 as shown in FIG. 5*b* at 67*a*, 64*a* and 67*b*, 64*b* respectively to define the path of travel of the bolt 60 between its first and second positions BP1, BP2 respectively. In a sense the rail-like portions are a tongue in the cooperating groove indentations. In addition, the close fitting cooperating guides serve to transfer to housing 20 the force of lateral impacts expected to be received from time to time by bolt 60 in its second position BP2.

Other means that help guide the bolt 60 in its path of travel include first and second elongated slots 28, 29 that extend through the wall 31. The elongated slots 28 and 29 receive, respectively, protrusions or hooks 61*a* and 63 extending outwardly from the bolt 60. These slots 28, 29 parallel the raised portions 26 and the respective indentation in which they slide to allow smooth movement.

Each of the parts; housing 20, bolt 60 and latch 90, are manufactured to very close tolerances, hence they interfit very closely to provide relatively large and resistive areas over which forces may be transferred. The parts and tolerances are also designed to interfit in a manner whereby the succession of interfitting surfaces that are brought into contact upon impact are carefully predetermined. Each of the parts is molded of a high strength, high impact resistant plastic material, such as polycarbonate.

For purposes of economy, operation, aesthetics and ease of assembly, numerous features are included in the housing, bolt and latch. For example, the face plate 50 extends outwardly from the housing to cover the edge of an opening into which the housing 20 would be received. A thickened portion 55 at each end of the housing 20 serves as a reinforcement to resist curling on impact, which would permit the housing to lift. The thickened portion 55 also may serve to help fill the opening into which the housing 20 is fitted. A positioning means 21, approximately 0,080" to 0.150" thick, retains the housing 20 in place in the window frame as shown in FIG. 1, and resists forces from pulling the housing 20 out of the window frame upon impact. The positioning means 21 includes a pair of integrally formed resilient clips with one positioned on each of housing walls 33 and 43. A first or inner end 21*a* extends from a lower portion of walls 33 and 43 while the outer end 21*b* extends upwardly and away from the walls 33 and 43 to a position where the outer end is spaced below the face plate a distance just slightly greater than the expected thickness of the window structure. During installation, the end 21*b* flexes inwardly to allow the housing to fit into an opening and then springs back underneath the relatively thin material in a hollow sash construction or against the edges of a recess in a solid construction.

To allow installation of the bolt 60 in the first cavity 30 even though the protrusions 61*a* and 63 make the cross sectional profile of the bolt wider than the opening 51, the protrusions 61*a*, 63 have been located on portions of the bolt 60 that flex whereby they may be deformed to force the bolt through the opening 51. Once within the opening 51, the protrusions snap into the slots 28, 29 in which they then ride. The slots 28, 29 may be of equal length and provide an end surface 28*a*, 29*a* against which both of the protrusions abut as the bolt reaches its second position. The protrusions 61*a*, 63 in slots 28, 29 act as further guides and help transfer lateral forces from the bolt 60 to the housing 20.

A slot 62 separates portion 61 from a portion 65 and allows protrusion 61*a* on portion 61 to flex. A stop 62*a* disposed on the portion 65 limits the distance the protrusion 61*a* is permitted to flex. A path of ramp-shaped portions 27 on the interior surfaces 32*b* near back wall 35 are aligned with the slots 28, 29 and serve to force the protrusions up into the slots when the bolt 60 nears its first position. The protrusions 61*a*, 63 do not bear against ramps 27 in the second position.

On the outer surface 32*a*, indentations 27*a* are parallel to, and narrower than, interior portion 27 whereby the thickness of the wall 32 remains relatively constant in the area of the portions 27 thereby economizing on the materials used.

Another aspect of the invention concerns the means for facilitating the installation and operation of latch 90 in second cavity 40. These include a flexible abutment means generally indicated at 45 in FIG. 2. As shown, the flexible abutment 45 includes a portion 45*a* upstanding from wall 41. The portion 45*a* is surrounded by U-shaped slot 45*b* through wall 41 whereby portion 45*a* may flex outwardly to permit latch 90 to be inserted and then snap back to intermit with opening 91 in the latch structure 90. An inner wall 90*e* is spaced from abutment 45*a* a distance sufficient to allow latch 90 to reach its second position however at that point wall 90*e* abuts portion 45*a* to limit latch movement. A further projection 46 along the lower edge of wall 41 interfits with a notch 95 in latch 90 to provide further guidance and a stopping surface against which latch 90 may abut. A further groove 94 in the edge of latch 90 slides under a rear wall portion 47 of the second cavity 40 to provide a lower guide for the latch 90. An upper guide 48 comprises a groove extending along the upper edge of cavity 40 and receives the upper edge 90a of latch 90. The projection 98 on edge 90 extends through opening 54.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

We claim:

1. A stop means for limiting movement of a sliding window along a predetermined path of window movement, the stop means comprising:

a housing adopted to be positioned adjacent and out of said path of window movement, said housing having a first cavity and a second cavity adjacent to each other;

a bolt operatively associated with said first cavity being moveable along a predetermined first path between a first position wherein said bolt is locked within said first cavity against an outward bias and a second position wherein a first portion of said bolt extends out of said first cavity and a second portion of said bolt remains within said first cavity;

said first portion of said bolt in said second position adopted to extend into said path of window movement so as to contact said sliding window to define said limit of movement of said window along said path of window movement at which point of contact said second portion transfers forces resulting from said contact to said housing;

a latch within said second cavity moveable along a predetermined second path in a direction transverse to said first path between a first position biased toward and engaging said bolt, and a second position removed from engagement with said bolt;

an actuator on said latch for facilitating movement of said latch between said first position and said second position to unlock said bolt;

a spring positioned between said housing and said bolt biasing said bolt toward said second position; and, a guide comprising a tongue and groove arrangement between said bolt and said housing to maintain said bolt within close tolerance of said first path, and to guide said bolt along said first path, and to transfer lateral loads from said bolt to said housing, said bolt receiving said lateral loads from said contact of said sliding window with said first portion of said bolt.

2. The stop means according to claim 1 wherein said first cavity and said bolt each include first and second surfaces with said first surface of said first cavity facing and closely spaced to said first surface of said bolt and said second surface of said first cavity facing and closely spaced to said second surface of said bolt and wherein said guide includes on said first surfaces of said first cavity and said bolt and on said second surfaces of said first cavity and said bolt either a rail-like guide projection or a recess to receive said rail-like guide projection in a close tolerance relationship therewith to guide said bolt along said first path and to absorb and transfer forces between said bolt and said housing.

3. The stop means according to claim 1 wherein said guide includes a slot on said housing, said slot being in a first wall of said first cavity, said slot on said housing cooperating with a hook on said bolt between and at said first and second positions, said slot being oriented in said direction of said first path of movement of said bolt, said hook being on said second portion of said bolt and projecting into said slot so that said hook are slidable in said slot along said first path.

4. The stop means according to claims 2 wherein each of said first and second surfaces of said bolt includes a pair of spaced, parallel recesses and each of said first and second surfaces of said housing includes a pair of spaced, opposed parallel rail-like projections closely interfitting with said recesses and slidable therein as said bolt travels on said first path of movement.

5. The stop means according to claim 1 wherein said housing has a relatively long length, narrow width and a moderate depth to allow said housing to be fitted into a narrow track in a frame of the sliding window.

6. The stop means according to claim 5 wherein said housing length is in the order of more than five times said housing width and in the order of about three times the housing depth.

7. The stop means according to claim 6 wherein said bolt and latch have a thickness in the order of two thirds of the housing width.

8. A window stop means adapted to be positioned in a track of a sliding window adapted to move in a horizontal path, the window stop means comprising:

a narrow, elongated housing adapted to be fitted within the track of said sliding window whereby it will not interfere with the travel of said window in said track;

a bolt slidably mounted in said housing, said bolt being moveable vertically between a first position within said housing and thereby out of the path of said window and a second position extending vertically out of said housing into the path of said window whereby the bolt is able to contact said window;

a latch mounted within said housing movable horizontally between a first position biased onto engagement with said bolt means, and a second position removed from engagement with said bolt means; and a guide comprising a tongue and groove arrangement between said bolt and said housing to guide said blot between said first and second positions, and to transfer lateral loads from said bolt to said housing, said bolt receiving said lateral loads from said contact of said window with said bolt;

said bolt, latch and housing being of close interfitting relationship whereby horizontal impact forces received by said bolt will be transferred to said housing.

9. The window stop means according to claim 8 wherein said bolt has generally parallel opposite side surfaces and said housing has opposite interior wall surfaces generally parallel to each other and to said side surfaces of said bolt, said guide includes parallel projections on either said side surfaces of said bolt or said interior wall surfaces of said housing seated in parallel grooves on either said side surfaces of said bolt or said interior wall surfaces of said housing.

10. The window stop means according to claim 9 including a further guide, said further guide including protrusions on said bolt seated in mating slots in said housing, said slots in said housing being parallel to said grooves of said guide.

11. The window stop means according to claim 10 wherein said further guide include two spaced slots in one wall of said housing.

12. The window stop means according to claim 9 wherein said grooves are on opposite sides of said bolt and said projections are on opposite interior wall surfaces of said housing.

13. The window stop means according to claim 8 wherein said bolt has a thickness of about two thirds of the effective width of the housing.

14. The window stop means according to claim 13 wherein said latch has a thickness of about two thirds of the effective width of said housing.

15. The window stop means according to claim 14 wherein said housing has an opening to allow insertion of said latch and a means for biasing said latch into engagement with said bolt, said means for biasing positioned between said latch and said housing.

16. A stop for limiting movement of a sliding window along a path of sliding window movement, the stop comprising:

a housing adapted to be positioned adjacent the path of sliding window movement, the housing having a first cavity adjacent a second cavity;

a bolt moveable within the first cavity between a first position within the first cavity and second position extending out of the first cavity into the path of the sliding window;

a latch within the second cavity moveable in a direction transverse to said bolt, the latch engaging the bolt in a locked position and removed from engagement with the bolt in an unlocked position;

an actuator on the latch for moving the latch between its locked and unlocked positions; and, a means for guiding the bolt between its first and second positions which comprises a tongue and groove arrangement between the bolt and the housing to guide the bolt along its movement and to transfer lateral loads from the bolt to the housing, the bolt receiving the lateral loads from the sliding window contacting the bolt when the bolt is in its second position.

17. The stop means according to claim 16 wherein the tongue and groove arrangement includes the housing having rail-like guide projections on interior surfaces of the first cavity of the housing and the bolt having groove indentations on its outer surfaces that cooperate with the rail-like guide projections.

18. The stop means according to claim 16 wherein the tongue and groove arrangement includes a slot on an interior wall of the first cavity and a hook extending outwardly from the bolt, the hook cooperating with the slot.

19. The stop means according to claim 16 wherein the bolt has a first notch and a second notch and the latch has a protruding portion, the protruding portion cooperating with the first notch when the bolt is in its first position and cooperating with the second notch when the bolt is in its second position.

20. The stop means according to claim 19, wherein the second notch has an inclined upper cam surface to move the protruding portion towards the unlocked position of the latch when the bolt is moved from its second position to its first position.

* * * * *

UNITED STATES PATENT AND TRADEMARK OFFICE

CERTIFICATE OF CORRECTION

PATENT NO. : 5,553,903

DATED : September 10, 1996

INVENTOR(S) : James G. Prete, Steven E. Schultz and Allen D. Polowinczak

It is certified that error appears in the above-indentified patent and that said Letters Patent is hereby corrected as shown below:

Column 4, line 20, the number appearing as "0,038" should be -- 0.038 --

Column 4, line 20, the number appearing as "0,050" should be -- 0.050 --

Column 5, line 16, the number appearing as "0,080" should be -- 0.080 --

Column 7, line 18, the word appearing as "claims" should be -- claim --

Column 7, line 53, the word appearing as "blot" should be -- bolt --

Signed and Sealed this

First Day of April, 1997

Bruce Lehman

BRUCE LEHMAN

*Commissioner of Patents and Trademarks*

*Attest:*

*Attesting Officer*